US006892822B2

(12) United States Patent
Mieger et al.

(10) Patent No.: US 6,892,822 B2
(45) Date of Patent: May 17, 2005

(54) CONSTRUCTION MACHINE WITH RAPID-ACTION COUPLING

(75) Inventors: Rolf Mieger, Kirchdorf-Unteropfingen (DE); Thomas Zitterbart, Dietenheim (DE)

(73) Assignee: Liebherr-Hydraulikbagger GmbH, Kirchdorf/Iller (DE)

( * ) Notice: Subject to any disclaimer, the term of this patent is extended or adjusted under 35 U.S.C. 154(b) by 0 days.

(21) Appl. No.: 10/465,752

(22) Filed: Jun. 19, 2003

(65) Prior Publication Data

US 2003/0233773 A1 Dec. 25, 2003

(30) Foreign Application Priority Data

Jun. 19, 2002 (DE) ..... 202 09 518 U

(51) Int. Cl.[7] ..... A01B 51/00
(52) U.S. Cl. ..... 172/272
(58) Field of Search ..... 37/347, 348, 403–407; 172/2–11, 272, 273; 701/50; 414/680, 685, 687, 688, 694, 722–724

(56) References Cited

U.S. PATENT DOCUMENTS

| | | | | |
|---|---|---|---|---|
| 5,333,400 | A | 8/1994 | Sonerud | |
| 5,465,513 | A | 11/1995 | Sonerud | |
| 6,241,455 | B1 * | 6/2001 | Schupback et al. | 414/723 |
| 6,662,881 | B2 * | 12/2003 | Domann | 172/272 |

FOREIGN PATENT DOCUMENTS

| | | |
|---|---|---|
| DE | 3135150 | 1/1983 |
| EP | 0768433 | 4/1997 |
| EP | 0860557 | 8/1998 |
| EP | 0866177 | 9/1998 |
| EP | 0989242 | 3/2000 |
| FR | 2676765 | 11/1992 |
| WO | 01/57324 | 8/2001 |

OTHER PUBLICATIONS

Schnabel, S. "Einsatz von Steuersystemen für hydraulische Schnellwechseleinrichtungen an Erdbaumaschinen," Tiefbau 9, 1998, pp. 634–637.

Cohrs, H.H., "Schellwechselsysteme für Bagger," tis 11/97, pp. 22–27.

Siemens, Klaas–Jürn, "Greifer–und Werkzeugwechsel bei Handhabungsgeraeten," VDI–Z., Bd. 126 (1984), NR. 4, Feb. (II), pp. 78–82.

* cited by examiner

*Primary Examiner*—Robert E Pezzuto
(74) *Attorney, Agent, or Firm*—Dilworth & Barrese LLP

(57) ABSTRACT

The invention pertains to a construction machine with a rapid-action coupling for coupling a tool to a boom, wherein a rapid-action coupling part is provided on the boom side and a rapid-action coupling part is provided on the tool side such that an energy circuit can be produced, and wherein the rapid-action coupling serves for automatically coupling an energy connection on the tool side to an energy connection on the boom side. According to the invention, an identification system is provided which comprises means on the tool side which serve for identifying the type and the size of the tool, as well as a device on the construction machine side which serve for reading out and processing the information.

6 Claims, 1 Drawing Sheet

CONSTRUCTION MACHINE WITH RAPID-ACTION COUPLING

BACKGROUND OF THE INVENTION

The invention pertains to a construction machine with a rapid-action coupling for coupling a tool to a boom.

Construction machines with rapid-action couplings for coupling a tool to a boom are already known. These construction machines comprise a rapid-action coupling part on the boom side and a rapid-action coupling part on the tool side such that an energy circuit can be produced. For example, hydraulic couplings are used as energy circuit couplings in hydraulic excavators. An automatic attachment of the tool can be achieved with conventional rapid-action couplings, wherein the energy connection on the tool side is also automatically coupled to the corresponding energy connection on the boom side.

Construction machines, for example, hydraulic excavators, are equipped with highly different tools, for example, hoe-type buckets, shovels, grippers, hammers, shears, cutters, ripper teeth, load hooks and the like. In addition to the above-mentioned hydraulic excavators, wheel loaders and other construction machines with corresponding booms are customarily utilized. The optional attachment of different tools has made it possible to utilize these construction machines as multi-function machinery.

The attachment of different tools has been significantly simplified with the introduction of rapid-action tool exchangers and the ability to simultaneously produce the required electric or hydraulic energy supply circuit when the tool is attached. However, this simplified attachment leads to the problem that the operating personnel of the construction machine is unable to detect possibly occurring technical and safety-related problems. For example, one technical problem may lie in the hydraulic pressure of the hydraulic unit on the construction machine side, the flow rate or even the oil used not being compatible with the hydraulically driven tool being attached. This can not only impair the functionality of the tool, but also lead to its complete destruction. Safety-relevant problems arise, for example, when excessively large or excessively heavy shovels are attached because the stability of the construction machine can no longer be ensured in this case when loads are lifted.

In addition, a collision, for example, with the cabin or aerial lines, etc., can be prevented by transmitting the kinematics data.

SUMMARY OF THE INVENTION

The invention consequently is based on the objective of additionally developing a construction machine with a rapid-action coupling in such a way that technical and safety-relevant risks during the automatic attachment of a tool to the construction machine are reliably prevented and a flawless function is ensured.

Based on a construction machine with a rapid-action coupling of the initially described type, this objective is, according to the invention, attained with the combination of characteristics. According to these characteristics, an identification system is provided which comprises means on the tool side which serve for identifying the type and the size of the tool and means on the construction machine side which serve for reading out and processing the tool-related information.

In the first step of the attachment of the tool, information on which tool was attached is transmitted to the construction machine by means of the identification system according to the invention, i.e., information on the weight and the content of, for example, the attached hoe-type bucket, the oil quantity and the oil pressure required for operating the tool and the tool dimensions.

In the second step, data is transmitted to the on-board computer which is subsequently forwarded, for example, to the hydraulic pump in order to adjust the correct quantity and pressure of the hydraulic oil. The available loading capacity can be determined from the transmitted weights and dimensions and displayed. In addition, the maximum range, the excavation depth and the height can be displayed or stored in the boom control as limiting values.

Preferred embodiments of the invention are disclosed herein.

The means on the tool side may consist of an electronic storage element, a transponder, a transmitter and/or a barcode. These means cooperate with the means for reading out and processing the information on the construction machine side. These means preferably form part of the on-board computer or are at least connected thereto. If the information on the tool side is, for example, stored in an electronic storage element, the electric signals can be forwarded to the construction machine in the form of individual contacts. If a transponder is provided on the tool side, a corresponding receiving element needs to be provided on the construction machine side. This also applies to a receiver on the construction machine side which cooperates with a receiver for exchanging radio signals provided on the tool side in addition, a system for reading out a barcode arranged on the tool may be provided on the construction machine side.

BRIEF DESCRIPTION OF THE DRAWINGS

Other details and advantages of the invention are illustrated in the enclosed figures that show one exemplary preferred embodiment. The figures show.

DESCRIPTION OF THE PREFERRED EMBODIMENTS

Figure 1:
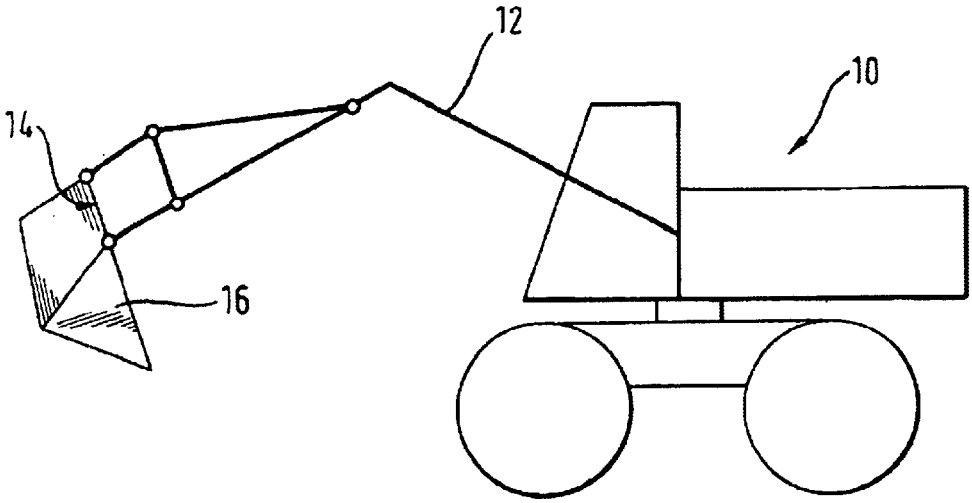
FIG. 1, a schematic side view of a construction machine with a rapid-action coupling according to the present invention.

FIG. 1 shows an exemplary construction machine in the form of a hydraulic excavator 10, to the boom 12 of which a tool exchanger 14 with an energy conduit is attached. This tool exchanger 14 is realized in the form of a rapid-action exchanger and able to automatically attach an arbitrary tool 16, wherein the energy circuit, in this particular example a hydraulic circuit, is simultaneously closed when the tool 16 is attached.

Figure 2A:
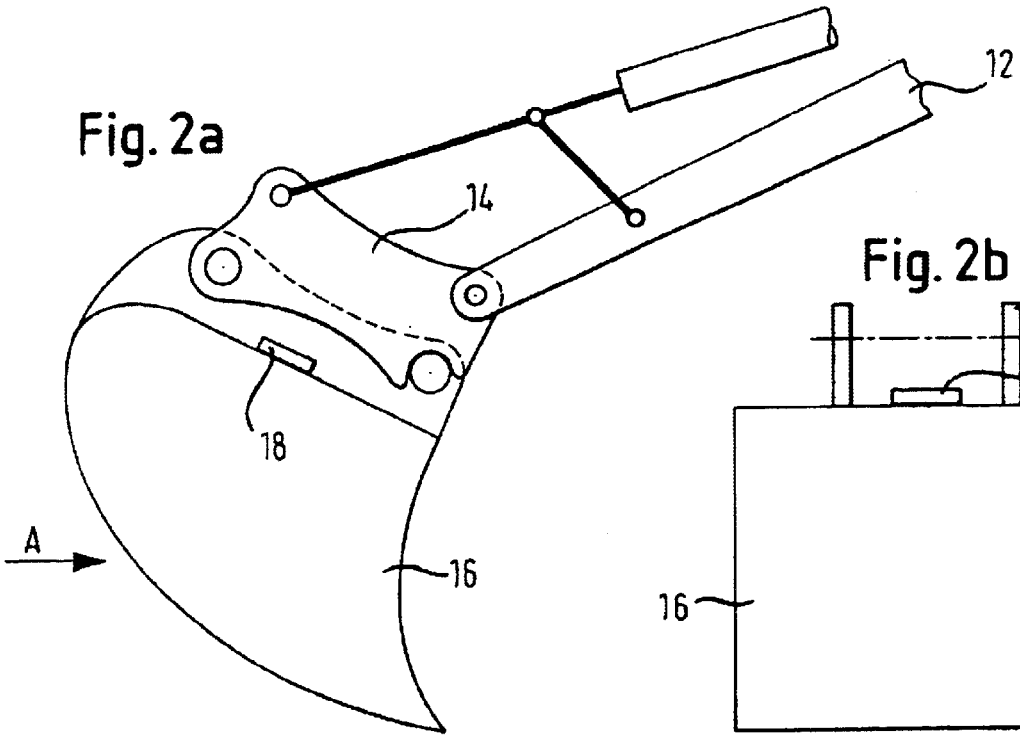
FIG. 2*a*, a detail of the schematic illustration according to FIG. 1, and FIG. 2*b*, a view in the direction of the arrow A in FIG. 2*a*.
Figure 2B:
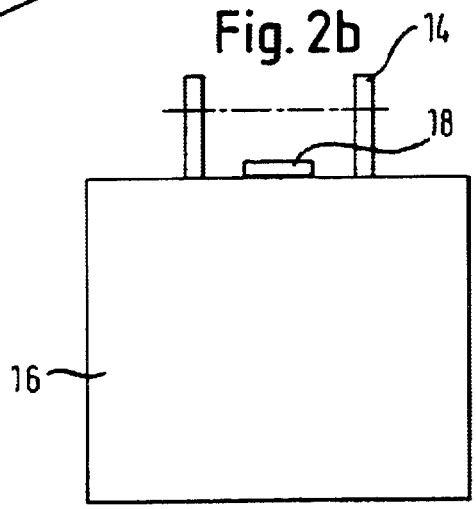

An enlarged detail of the boom 12 with the rapid-action coupling 14 and the tool 16 is shown in FIGS. 2*a* and 2*b*, namely in the form of a bucket 16 that is attached to the boom of the hydraulic excavator. This bucket 16 contains means 18 for identifying the type and the size of the tool which are realized in the form of a transponder and arranged on the tool side. When the bucket 16 is attached, this transponder 18 transmits information on the weight of the bucket and the content of the bucket to the not-shown on-board computer of the hydraulic excavator 10. The dimensions of the bucket 16 are also forwarded to the on-board computer. The oil quantities and pressure ratios of the hydraulic circuit required for the operation of the attached bucket are stored in a not-shown storage element of the on-board computer. After reading in the type of bucket 16, these data are made available to the on-board computer such that the hydraulic pump can be adjusted to the appropriate oil quantity and the correct oil pressure. It is also possible to simultaneously determine the loading capacity and the maximum reach or excavation depth and height of the excavator boom. Corresponding limiting values can also be generated in a safety control that reliably prevents operating errors. Safety controls of this type are already installed in known hydraulic excavators and consequently do not require a detailed description. They prevent, for example, an unstable position of the construction machine due to an excessively projecting heavy bucket.

What is claimed is:

1. A construction machine with a rapid-action coupling for coupling a tool to a boom, wherein a rapid-action coupling part is provided on the boom side and a rapid-action coupling part is provided on the tool side such that an energy circuit can be produced, and the rapid-action coupling serves for automatically coupling an energy connection on the tool side to an energy connection on the boom side, characterized by an identification system with means on the tool side which serve for identifying the type and the size of the tool and means on the construction machine side which serve for reading out and processing the information, and the fact that the means on the tool side consist of an storage element, a transponder, a transmitter and/or a barcode.

2. The construction machine according to claim 1, wherein the energy circuit is an hydraulic circuit.

3. The construction machine according to claim 1, characterized by the fact that the means on the construction machine side which serve for reading out and processing the information form part of the on-board computer or are connected thereto.

4. The construction machine according to claim 3, wherein the energy circuit is an hydraulic circuit.

5. A construction machine with a rapid-action coupling for coupling a tool to a boom, wherein a rapid-action coupling part is provided on the boom side and a rapid-action coupling part is provided on the tool side such that an energy circuit can be produced, and the rapid-action coupling serves for automatically coupling an energy connection on the tool side to an energy connection on the boom side, characterized by an identification system with means on the tool side which serve for identifying the type and size of the tool and means on the construction machine side which serve for reading out and processing the information, and the fact that the means on the construction machine side which serve for reading out and processing the information form part of the on-board computer or are connected thereto.

6. The construction machine according to claim 5, wherein the energy circuit is an hydraulic circuit.

* * * * *